United States Patent [19]

Aoyama

[11] Patent Number: 4,497,993

[45] Date of Patent: Feb. 5, 1985

[54] DOOR LOCK APPARATUS OF ELECTRIC COOKER

[75] Inventor: Shuki Aoyama, Aichi, Japan

[73] Assignee: Tokyo Shibaura Denki Kabushiki Kaisha, Japan

[21] Appl. No.: 513,287

[22] Filed: Jul. 13, 1983

[30] Foreign Application Priority Data

Jul. 16, 1982 [JP] Japan ..... 57-123966
Jul. 19, 1982 [JP] Japan ..... 57-109154[U]

[51] Int. Cl.[3] ..... H05B 6/76

[52] U.S. Cl. ..... 219/10.55 C; 219/10.55 D; 126/197; 200/50 A; 200/61.76

[58] Field of Search ..... 219/10.55 C, 10.55 D, 219/10.55 R; 126/197, 194; 200/50 A, 50 C, 61.62, 61.64–61.68, 61.7, 61.76–61.82

[56] References Cited

U.S. PATENT DOCUMENTS

| | | | |
|---|---|---|---|
| 2,957,959 | 10/1960 | Mellinger | 200/61.76 X |
| 3,742,162 | 6/1973 | Wasemann | 200/61.62 |
| 4,006,121 | 2/1977 | Isono | 219/10.55 C X |

FOREIGN PATENT DOCUMENTS

| | | | |
|---|---|---|---|
| 205553 | 1/1957 | Australia . | |
| 2949748 | 6/1980 | Fed. Rep. of Germany . | |
| 54-34150 | 3/1979 | Japan | 219/10.55 C |
| 55-49414 | 11/1980 | Japan . | |
| 607305 | 8/1948 | United Kingdom . | |
| 729045 | 5/1955 | United Kingdom . | |
| 773390 | 4/1957 | United Kingdom . | |

OTHER PUBLICATIONS

Abstract of Japanese No. 55–150436 dated Nov. 22, 1980.

Australian Patent Office Response dated Jun. 27, 1984.

German Patent Office Response dated Mar. 19, 1984.

*Primary Examiner*—P. H. Leung

*Attorney, Agent, or Firm*—Cushman, Darby & Cushman

[57] ABSTRACT

A door lock apparatus of an electric cooker has a handle movably supported by a door which is mounted on a housing of the cooker and capable of moving to open/-close an opening. Two hooks are pivotally mounted on the inner face of the door. Each hook is disposed engageable with the housing for locking the door in a closed position, thereby closing the opening and a switch for controlling an oscillation of a magnetron. The hooks are biased by biasing member to a position at which the hooks engage with the housing. Pushers are supported by the door to be movable along the axis thereof, respectively. Each pusher has two ends and abuts against the handle at one end and against the hook at the other end. When the handle is moved, each pusher pivots the hook to release engagement between the hook and the housing. Each hook has an arcuated action surface which abuts against the other end of the pusher. The biasing force of the biasing member is transmitted to the pusher through the action surface along the axis of the pusher.

9 Claims, 9 Drawing Figures

DOOR LOCK APPARATUS OF ELECTRIC COOKER

BACKGROUND OF THE INVENTION

The present invention relates to a door lock apparatus of an electric cooker and, more particularly, to a door lock apparatus for locking a door in a closed position.

An electric cooker such as a microwave oven has been widely used. The microwave oven supplies microwave energy generated by a magnetron to a heating chamber so as to heat food to be cooked. In a composite type microwave oven, however an electric heater is further disposed in the heating chamber. Each of these electric cookers is provided with a door lock apparatus for locking a door in a closed position to effectively cook foods and to avoid break out microwave energy from the heating chamber. The door lock apparatus has a hook and a handle. The hook pivotally mounted on the door can engage with the housing to lock the door in the closed position and thus securely close the opening. The handle is pivotally mounted on the front outer surface of the door. A rod-like pusher is disposed in the door between the hook and the handle. The pusher is supported by a pusher guide mounted on the door so as to be movable in a straight line along the axial direction thereof. The handle has a pressing surface which abuts against one end of the pusher. The hook has a pressing surface which abuts against the other end of the pusher. When the handle is pivoted, the pusher is urged by the pressing surface of the handle and moves straight toward the hook. The pusher then urges the pressing surface of the hook. As a result, the hook is pivoted to mechanically disengage from the housing, and the door can be opened.

The microwave oven has a switch for controlling oscillation of the magnetron. The switch is operated in accordance with the opening/closing of the door. In other words, the switch is actuated in response to pivotal movement of the hook. The magnetron can be oscillated only when the door is closed.

The pressing surface of the handle is conventionally flat, so that upon pivotal movement of the handle, the urging force acts on the pusher in a direction perpendicular to the pressing surface of the handle. At the beginning of pivotal movement of the handle, the direction of the urging force acting on the pusher through the pressing surface is substantially the same as the axial direction of the pusher. Therefore, the pusher is smoothly displaced. However, the handle exerts force on the pusher in a direction inclined to the axis of the pusher while it is being pivoted. For this reason, the pusher is pressed onto the inner surface of the pusher guide. Frictional force between the pusher and the pusher guide is thus increased, so that a large force is required to pivot the handle. In addition to this disadvantage, the pusher and the pusher guide tend to wear away and deform. The pivotal movement of the handle, and hence the opening/closing operation of the door, becomes unstable. The press surface of the hook is also flat, and so the above problem also arises in the relationship between the pusher and the pressing surface of the hook. When the pusher and the pusher guide become worn away and deformed, the pusher cannot properly pivot the hook. Therefore, the operation of the switch becomes unstable, and microwave energy may leak out.

SUMMARY OF THE INVENTION

The present invention has been made in consideration of the above situation and has for its object to provide a door lock apparatus of an electric cooker wherein the deformation and wear of a pusher can be prevented, and the opening/closing operation of a door and the switching operation of a switch can be smoothly and properly performed.

According to an aspect of the invention, there is provided a door lock apparatus of an electric cooker, comprising: an operation member movably supported on a door of the cooker; a hook which is pivotally mounted on an inner surface of the door to oppose the operation member and which is disposed engageable with a housing of the cooker for locking the door in a closed position, thereby closing an opening of the housing and a switch for controlling an oscillation of a magnetron; a biasing member for biasing the hook to a position at which the hook engages with the housing; and a rod-like pusher supported in the door between the operation member and the hook to be movable along the axial direction thereof, the pusher having two ends and abutting against the operation member at one end and against the hook at the other end to pivot the hook upon movement of the operation member and hence to release engagement between the hook and the housing, the hook being provided with an arcuated action surface which abuts against the other end of the pusher and which transmits a biasing force of the biasing member to the pusher along the axis thereof.

As described above, the hook has an arcuated action surface, so that the direction of the biasing force acting on the pusher through the hook is constantly aligned with the axial direction of the pusher. No sideways pressure can be applied to the pusher. Therefore, no shearing force can act on the pusher, which is therefore not subject to deformation. Furthermore, no excessive frictional force can act between the pusher and the door, thereby decreasing friction and wear between the pusher and the door. For this reason, no excess play develops between the pusher and the door through long use, so that the pusher will always cause the hook to operate properly. Therefore, in the proposed door lock apparatus according to the present invention, the opening/closing of the door and the switching operation of the switch can be properly and smoothly performed.

BRIEF DESCRIPTION OF THE DRAWINGS

FIGS. 2 to 6 show a door lock apparatus according to a first embodiment of the present invention, in which FIG. 2 is an exploded perspective view thereof, FIG. 3 is a cross-sectional view thereof, FIG. 4 is a longitudinal sectional view thereof, FIG. 5 is an enlarged view showing an essential part thereof, and FIG. 6 is an enlarged view showing another essential part thereof;

DETAILED DESCRIPTION OF THE PREFERRED EMBODIMENTS

Preferred embodiments of the present invention will be described with reference to the accompanying drawings.

Figure 1:
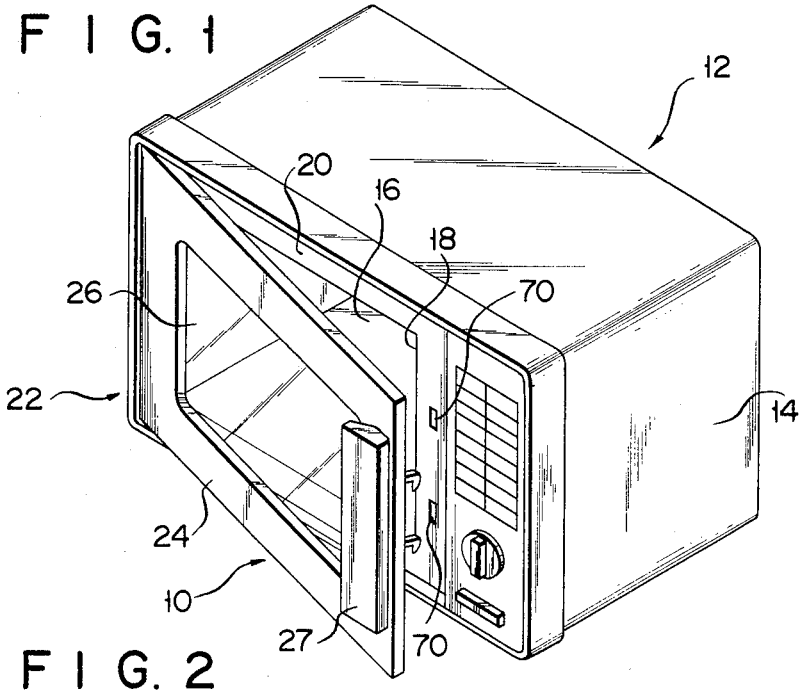
FIG. 1 is a perspective view of a microwave oven having a door lock apparatus of the present invention.

FIG. 1 shows a microwave oven 12 having a door lock apparatus 10 according to a first embodiment of the present invention. The microwave oven 12 has a housing 14. The housing 14 has a heating chamber 16 therein. The housing 14 also has a rectangular opening 18 through which food is placed in or taken out of the heating chamber 16, and a front frame 20 fixed to the housing 14. A door 22 is pivotally mounted on the housing 14 to open/close the opening 18. The door 22 has a rectangular frame 24 and a glass plate 26 mounted in the frame 24 to cover a microwave screening plate (not shown).

Figure 2:
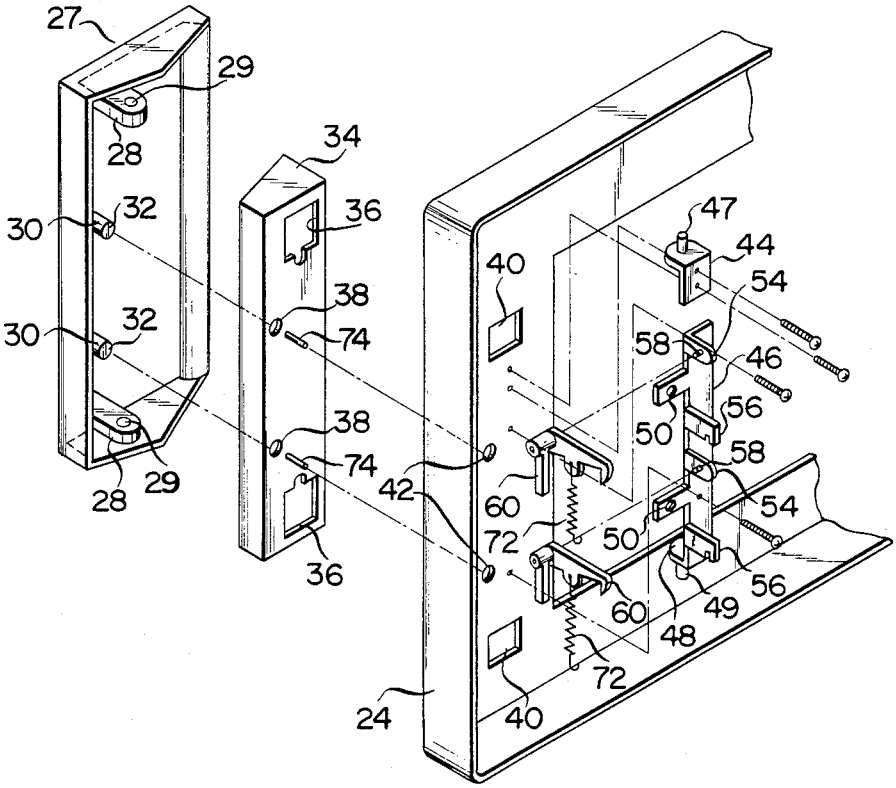
Figure 3:
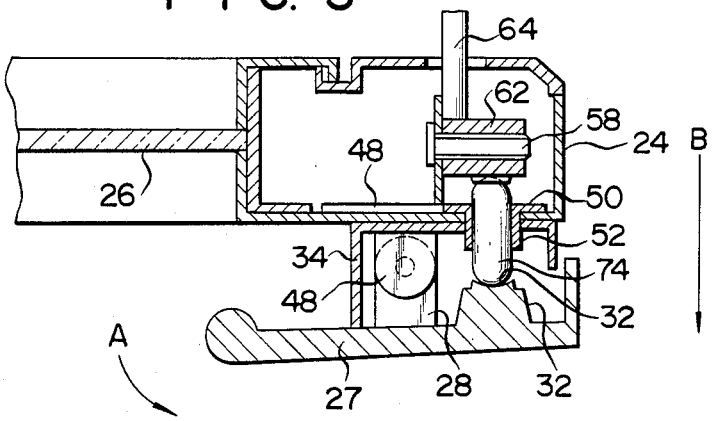
Figure 4:
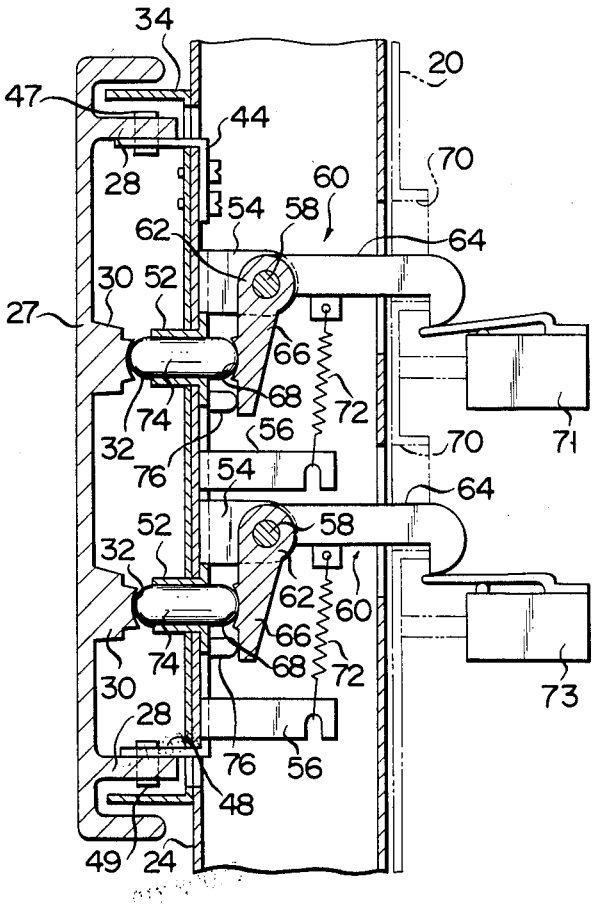

As shown in FIGS. 2 to 4, the door lock apparatus 10 has an operation member or a handle 27 pivotally mounted on the front surface of the frame 24 of the door 22. The handle 27 has a pair of support arms 28 extending from the inside thereof toward the door 22. These support arms 28 are spaced apart from and parallel to each other. Each support arm 28 has a through hole 29 formed at the extended end portion thereof. A pair of projections 30 extend from the inside of the handle 27 toward the door 22. A pressing surface 32, a semispherical concave surface, is formed at the distal end of each projection 30. A handle cover 34 is mounted at the front surface of the frame 24 and is located inside the handle 27. A pair of rectangular openings 36 respectively opposing the support arms 28 and a pair of circular through holes 38 respectively opposing the projections 30 are formed in the handle cover 34. A pair of rectangular openings 40 respectively opposing the openings 36 of the handle cover 34 and a pair of circular through holes 42 respectively opposing the through holes 38 are formed in the frame 24.

A hinge member 44 and a support member 46 are screwed on the inner surface of the frame 24 so as to pivotally support the handle 27. The hinge member 44 has an L-shape, and the upper portion thereof extends outside the frame 24 through the corresponding openings 40 and 36. The hinge member 44 has a support pin 47 extending upward therefrom. The support member 46 is formed of an elongate plate, and its lower end portion is bent at a right angle to form a hinge portion 48. The hinge portion 48 extends outside the frame 24 through the corresponding openings 40 and 36, and has a support pin 49. The support pins 47 and 49 are inserted in the corresponding through holes 29 of the support arms 28, respectively, thereby pivotally supporting the handle 27. The support member 46 has a pair of pusher guide portions 50. Each pusher guide portion 50 has a cylindrical pusher guide 52. The pusher guides 52 are respectively fitted in the through holes 42 and 38 to extend outside the frame 24. Furthermore, the support member 46 has a pair of hook hinge portions 54 and a pair of stoppers 56 which extend inward from the frame 24. A support pin 58 extends from each hook hinge portion 54. The hinge portion 48, the pusher guide portions 50, the hook hinge portions 54 and the stoppers 56 are formed integrally with each other.

The door lock apparatus 10 has a pair of hooks 60 pivotally supported on the respective support pins 58 of the hook hinge portions 54. Each hook 60 has a cylindrical support portion 62 in which the corresponding support pin 58 is fitted, a hook portion 64 extending from the support portion 62, and a pusher seat portion 66 extending from the portion 62 in the direction perpendicular to the hook portion 64. Each pusher seat portion 66 has a semispherical concave action surface 68 formed to oppose the corresponding through hole 38 of the frame 24. The hook portions 64 can engage with engaging holes 70 (FIGS. 1 and 2) formed in the front frame 20 of the housing 14, respectively. A torsion coil spring 72 is hooked between each hook 60 and the corresponding stopper 56. Each hook 60 is biased by the corresponding torsion coil spring 72 in a direction such that the hook portion 64 engages with the corresponding engaging hole 70 (i.e., each hook 60 is biased to pivot clockwise in FIG. 4 about the corresponding support pin 58). Referring to FIG. 4, reference numerals 71 and 73 denote switches arranged in the microwave oven 12. These switches are connected to an electric source to control the magnetron oscillation. The switches 71 and 73 are actuated by the respective hook portions 64 of the hooks 60. In the state shown in FIG. 4 (i.e., when the hooks 60 engage with the front plate 20 and the door 22 is locked in the closed position (FIG. 4)), the contacts of the respective switches 71 and 73 are depressed by the hooks 60 and are turned on.

The door lock apparatus 10 has a pair of columnar pushers 74 respectively inserted in the pusher guides 52. Each pusher 74 is somewhat smaller in diameter than the corresponding pusher guide 52 and is slidably supported along the axial direction thereof. Each pusher 74 has semispherical convex ends which abut against the pressing surface 32 of the corresponding projection 30 and the action surface 68 of the corresponding pusher seat portion 66. The surfaces 32 and 68 have a diameter slightly larger than the semispherical convex surfaces at the ends of the pushers 74. Referring to FIG. 4, reference numeral 76 denotes a pair of stoppers extending inward from the frame 24 so as to respectively abut against the pusher seat portions 66 of the hooks 60.

The assembly of the door lock apparatus 10 will now be described.

The handle cover 34 is screwed onto the front outer surface of the frame 24. The hinge member 44 and the support member 46 are inserted in the openings 40 from the inner side of the frame 24, respectively, while the handle 27 is held by the handle cover 34. The support pins 47 and 49 are inserted in the respective through holes 29 of the support arms 28, and the handle 27 is temporarily fixed. In this state, the pushers 74 are previously mounted in the corresponding pusher guides 52 and the hooks 60 are mounted on the corresponding support pins 58. Each of the torsion coil springs 72 is hooked between the corresponding hook 60 and the corresponding stopper 56. Thereafter, the position of the hinge member 44 is adjusted so as to align the pressing surfaces 32 of the handle 27 with the pushers 74. The hinge member 44 and the support member 46 are then permanently screwed in position. Subsequently, the switches 71 and 73 are aligned with the hooks 60, respectively. Thus, assembly of the door lock apparatus 10 is completed.

The operation of the door lock apparatus 10 having the construction as described above will now be described below.

Referring to FIGS. 3 and 4, when the handle 27 is pivoted in a direction indicated by arrow A, the pushers 74 are urged by the pressing surfaces 32 of the handle 27 and are moved toward the corresponding hooks 60. The pushers 74 urge the hooks 60 through the action surfaces 68, respectively. The hooks 60 are pivoted counterclockwise about the support pins 58 against the respective biasing forces of the torsion coil springs 72. Therefore, the hook portions 64 are released from the engaging holes 70, respectively. Under this condition, the door 22 is free to open. When the user then pulls the handle 27 in the direction indicated by arrow B, the door 22 is opened. Since the hook portions 64 are separated from the contacts of the switches 71 and 73, respectively, the switches 71 and 73 are turned off.

Figure 5:
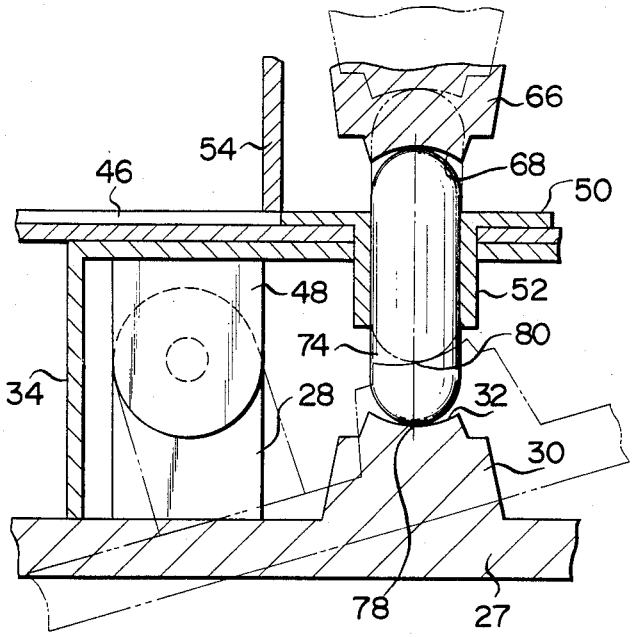
Figure 6:
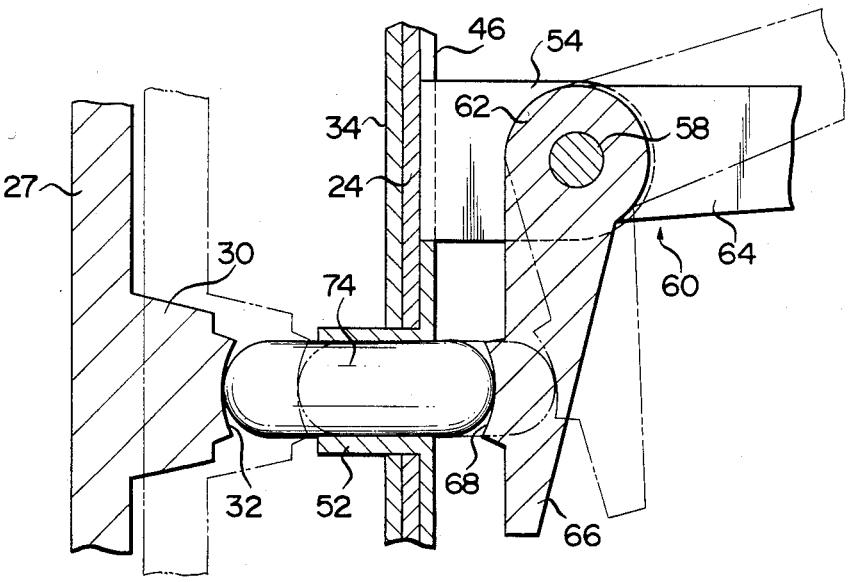

It should be noted that the operation of one of the pushers and its related members will be described with reference to FIGS. 5 and 6. When the handle 27 is pivoted, the pressing surface 32 is moved from the position indicated by the solid line to the position indicated by the alternate long and two short dashed line while the pressing surface 32 remains in contact with the one end of the pusher 74. In this case, the contact point between the press surface 32 and the one end of the pusher 74 is displaced from a position 78 to a position 80. Since the pressing surface 32 and the one end of the pusher 74 are semispherical surfaces, the contact point is always aligned on the central axis of the pusher while the handle 27 is being pivoted. For this reason, the direction of the urging force acting on the pusher 74 through the pressing surface 32 is always aligned with the direction of straight movement of the pusher (i.e., the axial direction of the pusher). This also applies to the relationship between the action surface 68 of the pusher seat portion 66 and the other end of the pusher 74. More particularly, the pusher 74 is urged into a position indicated by the alternate long-and-two-short dashed line, and when the urging force acting on the handle 27 is removed, the hook 60 is pivoted clockwise (in FIG. 6) by the biasing force of the torsion coil spring 72. The pusher 74 is urged by the action surface 68 and is returned to the position indicated by the solid line. In this case, since the action surface 68 and the other end face of the pusher 74 are semispherical surfaces, the contact point therebetween is always aligned on the central axis of the pusher. The direction of the urging force acting on the pusher through the surface 68 is always aligned with the axial direction of the pusher.

In this manner, the direction of the urging force acting on the pusher 74 through the surface 32 or 68 is always aligned with the moving direction of the pusher or the axis of the pusher. For this reason, no substantially excessive frictional force is present between the pusher 74 and the pusher guide 52, thereby smoothly performing pivotal movement of the handle 27 and the hook 60. Furthermore, no significant pressure (i.e., urging force in a direction different from the axis of the pusher) can act on the pusher. No remarkable shearing force can act on the pusher, so that the pusher cannot be deformed. In addition to this advantage, the deterioration of the pusher can be decreased. As a result, no excessive play can be developed between the pusher and the pusher guide through long and repetitious use. Therefore, proper locking of the door and accurate pivotal movement of the hook can continue to be performed in use over time. At the same time, the switches 71 and 73 can be properly actuated, thereby preventing leakage of the microwave energy.

According to the door lock apparatus 10 of this embodiment, since the pusher guide portions 50, the stoppers 56 and the hook hinge portions 54 are formed integrally, the number of component parts is decreased, resulting in easy management of the component parts and low manufacturing cost. Furthermore, since the pusher guides 52 are formed integrally with the respective hook hinge portions 54, the pushers 74 need not be aligned with the corresponding hooks 60 during assembly. At the same time, the interlocking operation between each pusher 74 and the corresponding hook 60 can be properly performed, thus increasing reliability. Along with this, the adjustment for preventing excessive play of the handle 27 and the hooks 60 can be simplified, so that the assembly time can be shortened and productivity can be improved. In addition to these advantages, the opening/closing operation of the door 22 can be smoothly performed so as to properly lock/unlock the door 22. As a result, the microwave energy is prevented from leaking out. Since the hook hinge portions 54 and the stoppers 56 are integrally formed with the support member 46, the torsion coil springs 72 can be easily mounted, thus further simplifying the assembly.

Figure 7:
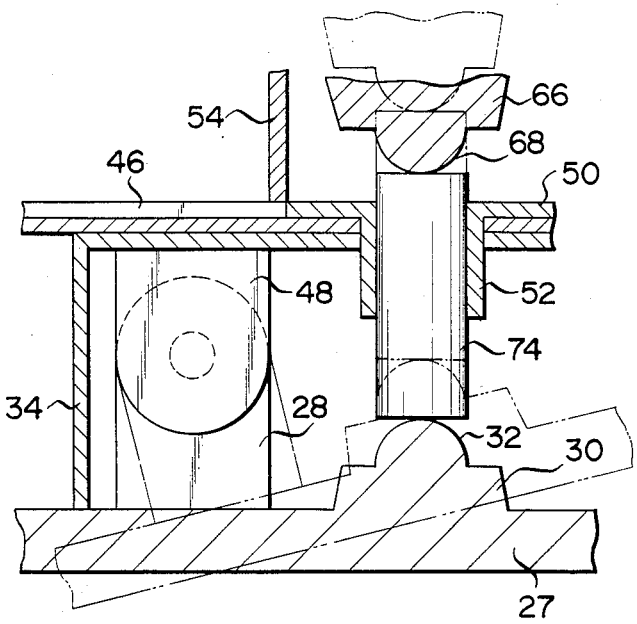
FIGS. 7 and 8 show a modification of the door lock apparatus of the first embodiment.
Figure 8:
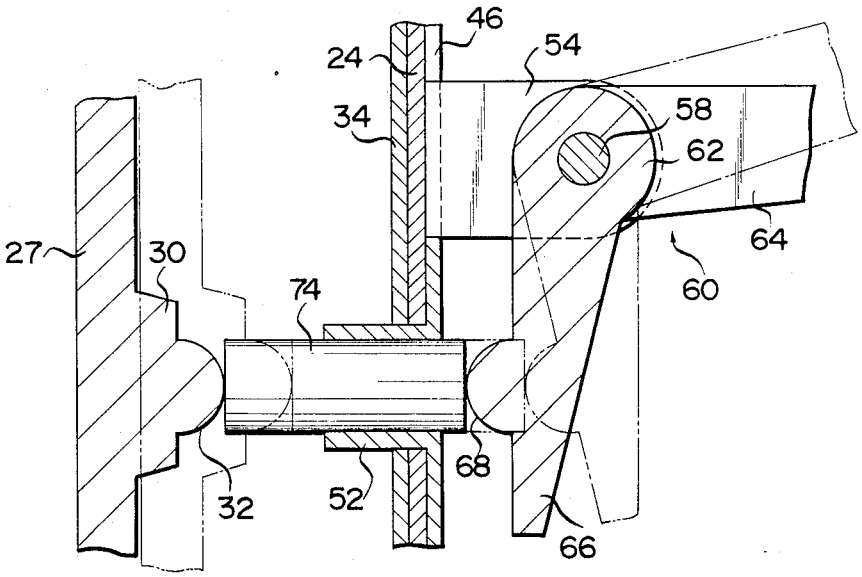

The present invention is exemplified by the above embodiment but is not limited thereto. Various changes and modifications may be made within the spirit and scope of the present invention. For example, in the embodiment described above, the surfaces 32 and 68 are semispherical concave surfaces and the two end faces of the pusher 74 are semispherical convex surfaces. However, the surfaces 32 and 68 and the end faces of the pusher 74 may be formed in a manner as shown in FIGS. 7 and 8. In this modification, these surfaces are semispherical convex surfaces, while the two end faces of pushers 74 are flat surfaces, respectively. These flat surfaces are perpendicular to the central axis of the pusher. The same effect as obtained in the above embodiment can be obtained with this modification.

Figure 9:
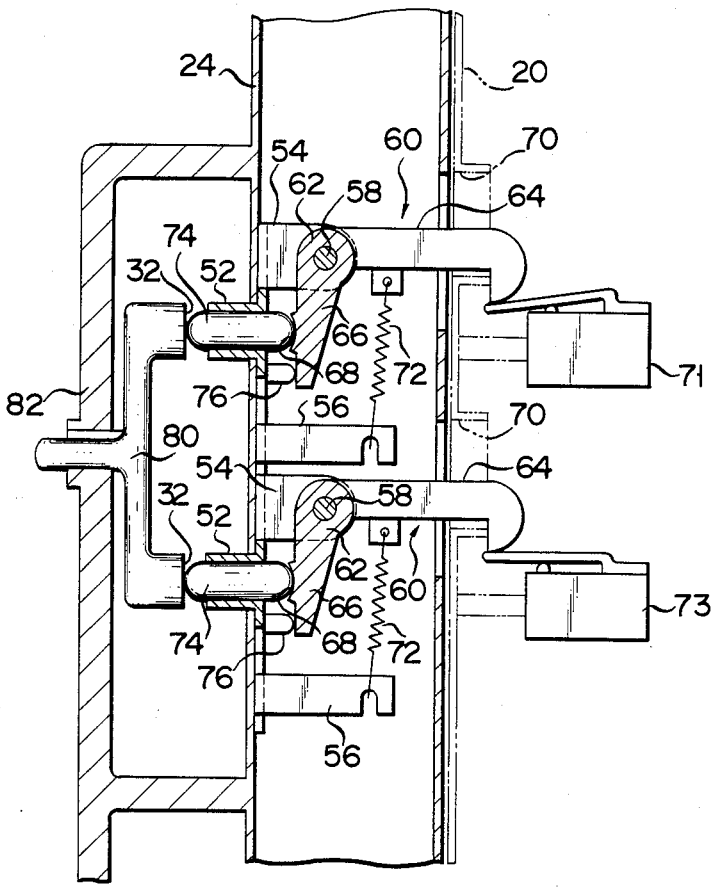
FIG. 9 is a longitudinal sectional view of a door lock apparatus according to a second embodiment of the present invention.

In the above embodiment, the operation member comprises the handle 27 pivotally mounted on the door 22. However, in a second embodiment as shown in FIG. 9, the operation member comprises an operation button 80 mounted in the door so as to be movable in a straight line along the axial direction of the pushers 74. In the second embodiment, a door 22 has a handle 82 fixed on a frame 24. The operation button 80 is movably supported along the axial direction of the pushers 74 by the handle 82. The operation button 80 has a pair of pressing surfaces 32 each of which abuts against a left end of a corresponding pusher 74. Each pressing surface 32 is flat and is perpendicular to the axial direction of the corresponding pusher 74. In this embodiment, the operation button 80 is moved along the axial direction of the pushers 74, so that the direction of the urging force acting on the pushers 74 through the respective pressing surfaces 32 is always aligned with the axial direction of the pushers 74, even though the pressing surfaces 32 are flat. Therefore, the same effect as obtained in the first embodiment can be obtained in the second embodiment. Also in the second embodiment, the two ends of the pusher 74 may be flat, and the surfaces 32 and 68 may both be semispherical, as described with reference to the modifications of the first embodiment.

What is claimed is:

1. An electric cooking apparatus comprising:

a housing;

a heating chamber provided in said housing;

a door mounted on said housing;

means for providing heating energy to said heating chamber;

a switch for controlling the power supply to said providing means; and means for locking said door, said locking means including an operation member pivotally supported on said door;

a hook pivotally mounted on said door to oppose said operation member and for engaging with said housing to lock said door in a closed position, thereby enabling said switch to turn on;

a biasing member for biasing said hook to a position at which said hook engages with said housing;

a pusher having two ends and abutting against said operation member at one end and against said hook at the other end to pivot said hook upon the movement of said operation member so as to release engagement between said hook and said housing; and pusher guide means supported by said door, said guide means for slideably supporting said pusher; wherein said operation member includes means defining an arcuated pressing surface which abuts against one end of said pusher to urge said pusher along the axis thereof upon the pivotal movement of said operation member, and wherein said hook includes means defining an arcuated action surface which abuts against the other end of said pusher and to which said pusher transmits a force only along an axis parallel with a reference axis of said pusher.

2. An apparatus according to claim 1, which further comprises a support member for pivotally supporting said operation member and said hook, said support member being mounted on said door and integrally having a hinge portion for pivotally supporting said operation member, a hook hinge portion for pivotally supporting said hook and a pusher guide portion on which said pusher guide means is mounted.

3. An apparatus according to claim 1, wherein said pusher is formed in a columnar shape and has semispherical convex ends, and said arcuated pressing and action surfaces are semispherical concave surfaces each having a radius of curvature slightly larger than that of each of the ends of said pusher.

4. An apparatus according to claim 1, wherein said pusher is formed in a columnar shape and has two flat end surfaces perpendicular to the axis of the pusher, and said arcuated pressing and action surfaces are both semispherical convex surfaces.

5. An apparatus according to claim 1, which further comprises a support member for pivotally supporting said operation member and said hook, said support member being mounted on said door and having a hinge portion for pivotally supporting said operation member, a hook hinge portion for pivotally supporting said hook and a pusher guide portion for guiding said pusher along the axis of the pusher.

6. An apparatus according to claim 5, wherein said support member has a stopper, and said biasing member is hooked between said hook and said stopper.

7. An electric cooking apparatus comprising a housing defining a heating chamber; a door mounted on said housing and moveable between open and closed positions to permit access to said heating chamber, said door including locking means for locking said door in said closed position and for unlocking said door when said door is to be moved to said open position; said locking means including:

(a) an operation member pivotally mounted on said door for movement between inoperable and operable positions;

(b) hook means pivotally mounted on said door at a position opposing said operation member for movement between unlatched and latched positions for engaging said housing to lock said door in said closed position;

(c) elongated pusher means slideably supported in said door between said operation member and said hook means for rectilinear movement between forward and rearward positions, said pusher means having one end adjacent said operation member and another end adjacent said hook means; and (d) motion translation means including means defining a first arcuate surface operatively coupling said one end of said pusher means and said operation member and means defining a second arcuate surface operatively coupling said other end of said pusher means and said hook means for (i) translating pivotal movement of said operation member into linear movement of said pusher means by virtue of said first arcuate surface to move said pusher means linearly from said forward position to said rearward position in response to said operation pivotally moving from said inoperable position to said operable position, and (ii) translating said linear movement of said pusher means into pivotal movement of said hook means by virtue of said second arcuate surface to pivotally move said hook means from said latched position to said unlatched position in response to said pusher means moving linearly between said forward and said rearward positions, whereby said hook means pivotally moves to said unlatched position in response to said operation member pivotally moving to said operable position.

8. An apparatus as in claim 7 further comprising:

heating means operatively associated with said heating chamber for supplying heat energy to said heating chamber; and switch means operatively connecting said hook means and said heating means for permitting operation of said heating means only when said hook means is in said latched position.

9. An apparatus as in claim 7 wherein said locking means further includes biasing means for biasing said hook means into said latched position.

* * * * *